United States Patent [19]

Keeffe et al.

[11] Patent Number: 4,859,899

[45] **Date of Patent: * Aug. 22, 1989**

[54] METAL-HALIDE LAMP HAVING HEAT REDISTRIBUTION MEANS

[75] Inventors: William M. Keeffe, Rockport; Zeya Krasko, Beverly, both of Mass.; Robert Karlotski, Weare, N.H.; James C. Morris, Wakefield, Mass.

[73] Assignee: GTE Products Corporation, Danvers, Mass.

[ * ] Notice: The portion of the term of this patent subsequent to Dec. 13, 2005 has been disclaimed.

[21] Appl. No.: 185,755

[22] Filed: Apr. 25, 1988

Related U.S. Application Data

[63] Continuation of Ser. No. 47,226, May 7, 1987.

[51] Int. Cl.[4] ..... H01J 61/34

[52] U.S. Cl. ..... 313/25; 313/634

[58] Field of Search ..... 313/25, 634

[56] References Cited

U.S. PATENT DOCUMENTS

| | | | |
|---|---|---|---|
| 3,234,421 | 2/1966 | Reiling | 313/25 |
| 4,321,504 | 3/1982 | Keeffe et al. | 313/620 |
| 4,499,396 | 2/1985 | Fohl et al. | 313/25 |
| 4,791,334 | 12/1988 | Keeffe et al. | 313/25 |

*Primary Examiner*—Kenneth Wieder

*Attorney, Agent, or Firm*—Joseph S. Romanow

[57] ABSTRACT

An improved metal-halide arc discharge lamp includes an arc tube having a substantially cylindrical body surrounded laterally by a substantially cylindrical heat-conserving sleeve within an evacuated outer envelope. The ratio of the outer radius of the arc tube divided by the inner radius of the sleeve falls within an optimum range of approximately 0.54 to approximately 0.68, and preferably within a range of approximately 0.60 to approximately 0.63. A lamp constructed in accordance with the invention exhibits improved luminous efficacy and color rendering in comparison to prior art counterparts. The improved performance is believed to be attributable to the more nearly isothermal operation of the arc tube for a given wall loading.

11 Claims, 3 Drawing Sheets

METAL-HALIDE LAMP HAVING HEAT REDISTRIBUTION MEANS

This is a continuation of co-pending application Ser. No. 047,226 filed on May 7, 1987.

CROSS REFERENCES TO RELATED APPLICATIONS

U.S. patent application, Ser. No. 621,648, filed June 18, 1984, assigned to the assignee hereof, contains related subject matter.

TECHNICAL FIELD

This invention relates to metal-halide discharge lamps and, more particularly to such lamps having means for heat conservation and redistribution about the arc tube.

BACKGROUND ART

Metal-halide discharge lamps usually are of intermediate or relatively high-wattage, such as 175 to 1500 watts. The luminous efficacy of such lamps decreases as the wattage of the lamp decreases. It had generally been believed that at wattages of 100 watts or less, metal-halide lamps would be unsatisfactory insofar as efficacy is concerned.

It is common practice in intermediate and relatively high-wattage lamps to provide an inert fill gas within the outer envelope in order to prevent oxidation of metal parts of the arc tube mount. Another advantage of the inert gas fill within the outer envelope is a high breakdown voltage which prevents arcing between metal parts of the arc tube mount. There is, however, an undesired heat loss due to convection currents of the inert gas within the outer envelope which reduces the lamp efficacy significantly, particularly with lower wattage lamps.

One known attempt to reduce the undesired heat loss due to convection currents within the outer envelope is disclosed in U.S. Pat. Nos. 4,499,396, and 4,580,989, both to Fohl et al. and assigned to the assignee hereof. Therein, a domed quartz sleeve is disposed within the gas-filled outer envelope of a metal-halide discharge lamp such that convection currents are suppressed and convective heat loss is substantially reduced. In U.S. patent application, Ser. No. 621,648, filed June 18, 1984 and assigned to the assignee hereof, there is disclosed a metal-halide discharge lamp having a light-transmissive enclosure about the arc tube within an evacuated outer envelope. The disclosure of 621,648 teaches that various temperatures over the body of the operating arc tube increase nonuniformly when an arc tube enclosure is employed in combination with an evacuated outer envelope. The hot spot temperature increases to a lesser extent than the cold spot temperature, so that the distribution of operating temperatures over the body of the arc tube is more nearly isothermal resulting in improved lamp performance. The disclosure of 621,648, however, provides no guidance on the choices of physical parameters for the enclosure vis-a-vis the arc tube in order to optimize the benefits of heat conservation and redistribution in an evacuated outer envelope.

The state of the art has advanced to the point where lower wattage metal-halide lamps are commercially feasible. Nevertheless, it would be a substantial contribution to the art if there were provided a lamp structure which optimized performance characteristics in metal-halide lamps of various wattages, particularly in lower wattage lamps.

DISCLOSURE OF THE INVENTION

It is, therefore, an object of the invention to obviate the deficiencies in the prior art.

Another object of the invention is to provide an improved internal lamp structure for a metal-halide lamp having an enclosure about the arc tube within an evacuated outer envelope such that lamp performance characteristics, e.g., luminous efficacy and color rendition, will be substantially improved.

A further object of the invention is to provide an improved internal lamp structure for a metal-halide lamp having an enclosure about the arc tube within an evacuated outer envelope such that heat loss is reduced and radiant heat re-radiated back to the arc tube will be more uniformly distributed over the body of the arc tube than is typical of its counterparts in the prior art.

Still another object of the invention is to provide an optimum range for positioning a heat-conserving enclosure about the arc tube of a metal-halide lamp having an evacuated outer envelope such that performance of the lamp is improved and life-limiting processes within the outer envelope are retarded.

Yet another object of the invention is to provide improved means for re-radiating radiant heat back to the arc tube and for distributing the re-radiated heat as uniformly as possible over the body of the arc tube such that the steady state operation of the arc tube will be more nearly isothermal than is found in comparable metal-halide lamps of the prior art.

These objects are accomplished, in one aspect of the invention, by the provision of an improved, metal-halide arc discharge lamp having a hermetically sealed outer envelope. The outer envelope has a longitudinal axis. An arc tube is mounted within the outer envelope. The arc tube has a substantially cylindrical body about the longitudinal axis and at least one end. The body of the arc tube encloses an interior containing a gaseous fill and a metal-halide additive. The body has an outer radius, r. A substantially cylindrical light-transmissive enclosure is mounted within the outer envelope about the longitudinal axis and surrounding the arc tube. The enclosure has an inner radius, R. There is a vacuum within the outer envelope. Means are provided for mounting the arc tube and enclosure. Acting in combination with the foregoing, the improvement comprises the ratio r/R being greater than approximately 0.54 and less than approximately 0.68, with a preferable range being approximately 0.60 to approximately 0.63. The ratio r/R is the value of the outer radius of the body of the arc tube divided by the value of the inner radius of the enclosure.

Lamps constructed as described above will exhibit what is believed to be optimum balancing between heat conservation on the one hand and radiant heat redistribution on the other hand within a wide range of rated wattages such that lamp performance will be substantially improved.

BEST MODE FOR CARRYING OUT THE INVENTION

For a better understanding of the present invention, together with other and further objects, features, advantages, and capabilities thereof, reference is made to the following disclosure and appended claims taken in conjunction with the above-entitled drawings.

Figure 1:
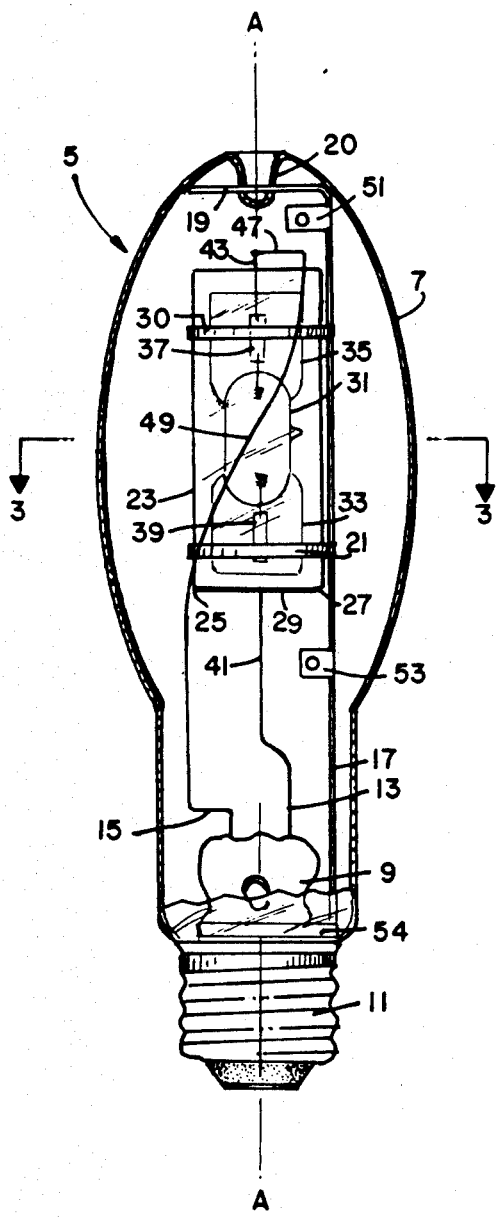
FIG. 1 is an elevational view of one embodiment of a metal-halide discharge lamp in accordance with the invention.

Referring to FIG. 1, a metal-halide arc discharge lamp 5 includes an evacuated outer envelope 7 having longitudinal axis A—A. Envelope 7 is hermetically sealed to glass stem 9 having an external base 11 affixed thereto. A pair of electrical conductors 13 and 15 are sealed into and pass through stem 9 and provide access for energization of the discharge lamp 5 by an external source.

Within outer envelope 7, support member 17 is affixed to stem 9 by strap 54, extends substantially parallel to longitudinal axis A—A, and forms circular hoop 19 near the upper portion of envelope 7. Hoop 19 encircles dimple 20 which maintains support 17 in proper alignment.

First strap 21 may be welded to support 17 extending in a direction normal to longitudinal axis A—A. Temperature-equalizing means 23 has a pair of oppositely disposed notches 25 and 27 on end 29 thereof. Notches 25 and 27 are formed to slip over first strap 21 which serves to support temperature-equalizing means 23. Second strap 30 also supports temperature-equalizing means 23 and is attached to support 17.

Arc tube 31 has a fill gas including a starting gas, mercury, and sodium and/or scandium metal halides. Arc tube 31 is double-ended in this embodiment; the arc tube has pinch seals at opposite ends thereof, 33 and 35 respectively. Metal foil members 37 and 39 are sealed into press seals 33 and 35, and electrical conductors 41 and 43 are attached to foil members 37 and 39 and extend outwardly from press seals 33 and 35. Conductor 13 is affixed to conductor 41 which passes through an opening in temperature-equalizing means 23. Lead 47 is affixed to conductor 43 which passes through an opening in temperature-equalizing means 23. Flexible conductor 49 connects lead 47 to conductor 15. Getters 51 and 53 are affixed to support 17 and serve to maintain the vacuum within outer envelope 7.

Temperature equalizing means 23 may be a cylindrical sleeve open at both ends, as shown in FIG. 1, enclosing or surrounding arc tube 31 laterally. In alternate embodiments of the invention, temperature equalizing means may be closed on one or both ends, such as a cylindrical sleeve with a dome on one or both ends. Laboratory examples have shown that a sleeve open at both ends functions as well as a sleeve with one or both ends closed as long as the open ends of the sleeve extend approximately to the end seals of the arc tube or beyond, and the dimensional limitations of the following discussion are adhered to. A lamp with an open sleeve is more economical to manufacture. For this reason, the sleeve open at both ends is preferred. Sleeve 31, preferably, is formed from quartz glass.

Figure 3:
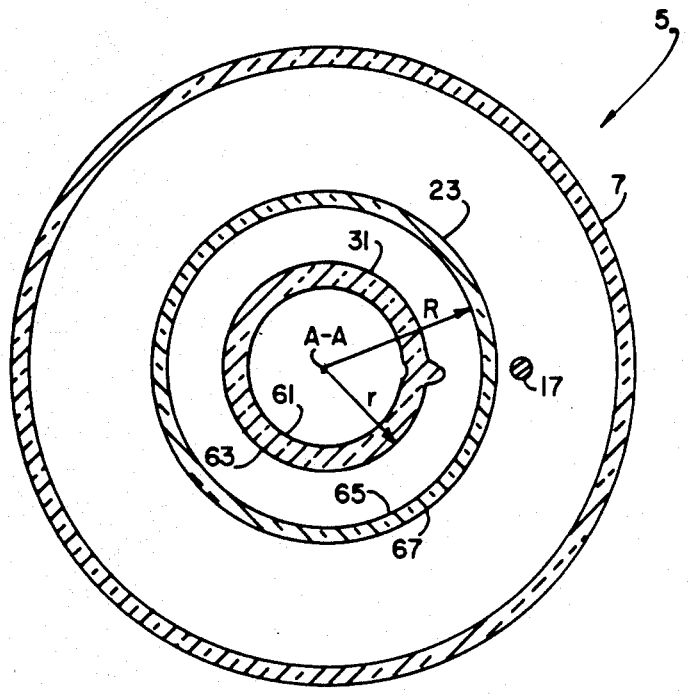
FIG. 3 is an enlarged cross-sectional view of lamp 5 along line 3—3 in FIG. 1, with parts omitted for clarity, showing the outer radius of the body of the arc tube and the inner radius of the enclosure surrounding the arc tube.

FIG. 3 is an enlarged cross-sectional view of lamp 5 taken along line 3—3 of FIG. 1 with certain parts omitted for clarity. In FIG. 3, arc tube 31, enclosing sleeve 23, and outer envelope 7 are shown as concentric surfaces or walls about longitudinal axis A—A. Arc tube wall 31 has an inner surface 61 and an outer surface 63. Enclosure wall 23 has inner surface 65 and outer surface 67. The outer radius, r, of arc tube 31 extends from axis A—A to outer surface 63 of arc tube 31. The inner radius, R, of sleeve 23 extends from axis A—A to inner surface 65 of sleeve 23.

In the prior art, the balance between satisfying the requirements for heat conservation on the one hand and heat equalization or redistribution on the other has failed to be recognized. It is known that a transparent quartz sleeve surrounding an arc tube will conserve heat, and that the conservation is greatest when the ratio of the surface area of the arc tube to the surface area of the sleeve approaches unity for the ideal case of infinite cylinders. See C. S. Liu, *Heat Conservation System for Arc Lamps,* Journal of the Illuminating Engineering Society, Vol. 8, No. 4, July 1979. Equivalently in the lamp of FIGS. 1 and 3, as the ratio r/R approaches unity, heat conservation is known to improve. What has failed to be recognized in the past is that the radiant heat redistribution follows different scaling rules. The surprising result taught by the present invention is that the additional requirement of uniform heat redistribution establishes an optimum radius ratio, r/R (of FIG. 3), considerably less than that of heat conservation solely. Specifically, the optimum radius ratio falls within the range of approximately 0.54 to approximately 0.68, and preferably within the range of approximately 0.60 to approximately 0.63, for lamps with rated wattages of approximately 100 watts to approximately 400 watts. Moreover, from laboratory experiments conducted thus far, it is expected that this optimum range will apply rather universally to lamps with rated wattages substantially below 100 watts and substantially above 400 watts.

In a first laboratory example, a 100 watt metal-halide lamp exhibited optimum heat conservation and redistribution with an arc tube having an outer radius of approximately six millimeters and a sleeve inner radius of ten millimeters. The term "optimum" is used to indicate the best values of luminous efficacy and color uniformity. By "best value of luminous efficacy", it is meant that the ratio of the luminous output from the lamp (as measured in "lumens") to the electrical power input to the lamp (as measured in "watts") approaches a maximum attainable numerical value. By "best value of color uniformity", it is meant that measures of lamp color, such as for example the "chromaticity coordinates", maintain the same or nearly similar values: (a) from one lamp to the next, (b) over life as the lamp ages, and/or (c) when the lamp is operated in various orientations with respect to the direction of gravity. In a second laboratory example, a 400 watt metal-halide lamp exhibited optimum luminous efficacy and color uniformity with an arc tube having an outer radius of eleven millimeters and an inner sleeve radius of 17.5 millimeters.

Figure 2:
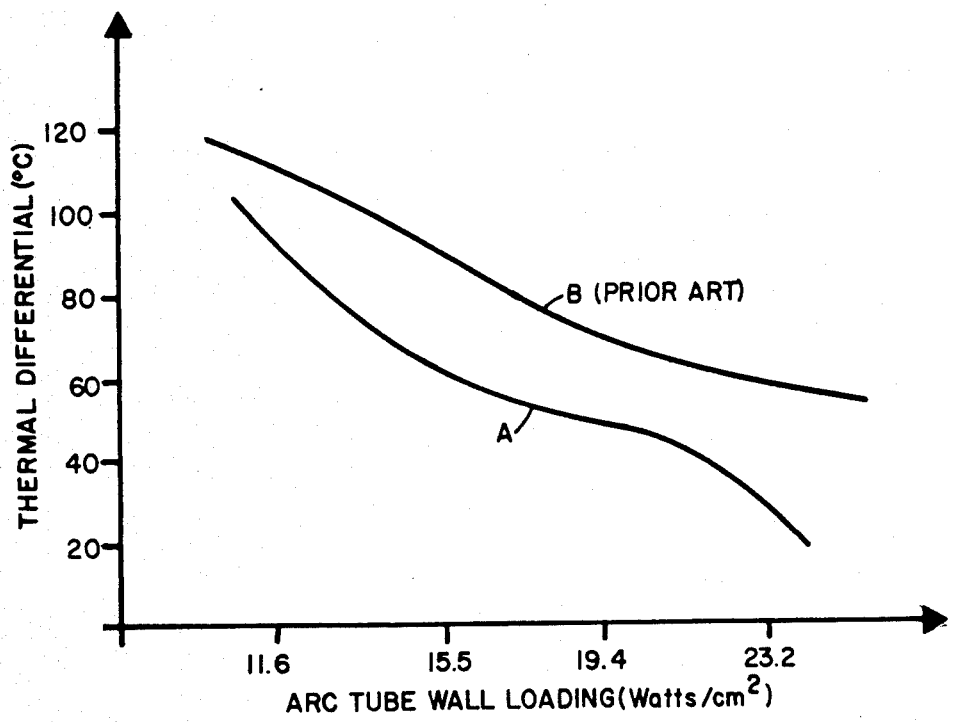
FIG. 2 is a graph of the thermal differential, i.e., hot spot minus cold spot temperature, as a function of arc tube wall loading for a lamp in accordance with the invention and a comparable lamp of the prior art.

Referring to the comparison graphs of FIG. 2, it can be seen that the thermal differential or the difference in temperature (degrees Centigrade) between the hot and cold spots (i.e., points of highest and lowest temperature) of the surface of a discharge tube varies in accordance with the wall loading (watts/cm$^2$) of the arc tube. The temperature differential is uniformly less for a metal-halide discharge lamp having an evacuated outer envelope (Curve A) than with a discharge lamp having a gas-filled outer envelope (Curve B). In both instances, the discharge lamps were 100-watt metal-halide discharge lamps having a quartz envelope surrounding an arc tube. In Curve A, the lamps in accordance with the invention had a radius ratio of approximately 0.60. Specific data from Curve A are tabulated in the following table.

TABLE I

| CURVE A* | |
|---|---|
| Wall Loading (Watts/cm$^2$) | Thermal Differential (Degrees Centigrade) |
| 11.6 | 93 |
| 15.5 | 60 |
| 19.4 | 44 |
| 23.2 | 28 |

*All lamps had a radius ratio of approximately .60

One would expect that the operating temperatures over the body of the arc tube would increase uniformly with the outer envelope evacuated. However, the temperature differential increases nonuniformly when an arc tube enclosure is employed in combination with an evacuated outer envelope. By "nonuniformly," it is meant that the hot spot temperature increases to a lesser extent than the cold spot temperature so that the distribution of operating temperatures over the body of the arc tube is more nearly isothermal.

There are substantial benefits derived from the more nearly isothermal operation of the arc tube. Generally, most lamp characteristics, e.g., luminous efficacy, will improve as the operation of the arc tube approaches that of isothermal. For a fixed hot spot temperature, the cold spot is hotter than expected. This improves color rendition because more of the metal halide additive is in the vapor state. For a given cold spot temperature, the hot spot is cooler than expected. Consequently, the free sodium and/or scandium in the additive will be less reactive with the quartz wall of the arc tube in the vicinity of the hot spot. Because temperature differentials are reduced, thermal stresses within the arc tube wall will be reduced.

FIG. 2 shows that the isothermal operation of the arc tube having a heat-conserving sleeve enclosure within an evacuated outer envelope is directly related to the wall loading. The present invention adds to and improves this principle by teaching that for a given wall loading, the isothermal operation of the arc tube can be optimized by dimensioning the sleeve such that the r/R radius ratio falls within a prescribed optimum range for a relatively wide range of rated lamp wattages. For a given wall loading, the invention demonstrates that a lamp designer has another choice of scaling parameters which may significantly affect lamp performance.

While there has been shown and described what is at present the preferred embodiments of the invention, it will be obvious to those skilled in the art that various changes and modifications may be made therein without departing from the invention as defined by the appended claims.

We claim:

1. In a metal-halide arc discharge lamp having:

(a) a hermetically sealed outer envelope having a longitudinal axis;

(b) an arc tube mounted within said outer envelope, said arc tube having a substantially cylindrical body about said longitudinal axis and at least one end, said body enclosing an interior containing a gaseous fill and a metal-halide additive, said body having an outer radius, r;

(c) a substantially cylindrical light-transmissive enclosure mounted within said outer envelope about said longitudinal axis and surrounding said arc tube, said enclosure having an inner radius, R;

(d) a vacuum within said outer envelope; and (e) means for mounting said arc tube and said enclosure;

the improvement comprising in combination:

(f) the ratio r/R being greater than approximately 0.54 and less than approximately 0.68.

2. A lamp as described in claim 1 wherein said body of said arc tube has a predetermined wall loading and during steady state operation of said lamp said body has a point of highest temperature and a point of lowest temperature, the difference between said highest and lowest temperatures being less than approximately 93 degrees Centigrade when said predetermined wall loading is at least 11.6 watts per square centimeter.

3. A lamp as described in claim 1 wherein said difference between said highest and lowest temperatures is less than approximately 60 degrees Centigrade when said predetermined wall loading is at least 15.5 watts per square centimeter.

4. A lamp as described in claim 1 wherein said difference between said highest and lowest temperatures is less than approximately 44 degrees Centigrade when said predetermined wall loading is at least 19.4 watts per square centimeter.

5. A lamp as described in claim 1 wherein said metal-halide additive includes sodium.

6. A lamp as described in claim 1 wherein said metal-halide additive includes scandium.

7. A lamp as described in claim 1 wherein said lamp has a rated wattage of approximately 400 watts or less.

8. A lamp as described in claim 1 wherein said arc tube is double-ended.

9. A lamp as described in claim 8 wherein said arc tube has seals at opposite ends thereof, said enclosure comprises a cylindrical sleeve open at both ends, and the ends of said enclosure extend approximately to the end seals of said arc tube, or beyond.

10. A lamp as described in claim 1 wherein said enclosure has a dome on one end thereof.

11. A lamp as described in claim 1 wherein the ratio r/R is greater than approximately 0.60 and less than approximately 0.63.

* * * * *